US005829499A

United States Patent [19]

Liao

[11] Patent Number: 5,829,499

[45] Date of Patent: Nov. 3, 1998

[54] WOOD PLANING MACHINE

[76] Inventor: Juei-Seng Liao, No. 295, Sec. 1, Nan-King E. Rd., Taichung City, Taiwan

[21] Appl. No.: 3,632

[22] Filed: Jan. 7, 1998

[51] Int. Cl.[6] ..... B27C 1/14

[52] U.S. Cl. ..... 144/130; 144/117.1; 144/129; 403/109.1; 403/330; 403/374.5; 403/377

[58] Field of Search ..... 144/114.1, 117.1, 144/129, 130, 120, 373; 403/109.1, 109.3, 110, 202, 234, 237, 300, 326, 330, 341, 343, 374.5, 377

[56] References Cited

U.S. PATENT DOCUMENTS

| | | | |
|---|---|---|---|
| 2,624,382 | 1/1953 | Moore | 144/130 |
| 2,780,251 | 2/1957 | Williams | 144/130 |
| 2,859,780 | 11/1958 | Carlson | 144/130 |
| 3,727,654 | 4/1973 | Mochizoki | 144/129 |

*Primary Examiner*—W. Donald Bray
*Attorney, Agent, or Firm*—Christie, Parker & Hale, LLP

[57] ABSTRACT

In a wood planing machine, two pairs of spaced front and rear pillars extend upwardly from a bed at opposite end portions of the latter. Each of two upright threaded rods is mounted stationarily on a respective one of the opposite end portions of the bed between a respective one of the pairs of spaced front and rear pillars. An upper housing has opposite end portions through which the front and rear pillars extend slidably. Each of the opposite end portions of the upper housing has a transmission gear that is mounted rotatably thereon and that has a respective one of the threaded rods extending threadedly therethrough. The upper housing further has a horizontal coupling rod mounted rotatably thereon. The coupling rod is provided with a pair of driven members that engage the transmission gears on the upper housing. The wood planing machine is further provided with a locking unit to permit locking of the upper housing at a desired height relative to the bed.

7 Claims, 8 Drawing Sheets

WOOD PLANING MACHINE

BACKGROUND OF THE INVENTION

1. Field of the Invention

The invention relates to a wood planing machine, more particularly to one which generates a minimum amount of noise when an upper housing thereof is adjusted and which incorporates a locking unit for locking releasably the upper housing at a desired height with respect to a bed.

2. Description of the Related Art

Referring to FIGS. 1, 2 and 3, a conventional wood planing machine 10 is shown to comprise a bed 14 over which a wooden work piece (not shown) passes, and an upper housing 11 above the bed 14. A cutting roller 115 is mounted on the upper housing 11 and is rotatable about a horizontal axis. Front and rear feed rollers 113, 114 are similarly mounted on front and rear portions of the upper housing 11 and are rotatable about axes parallel to the cutting roller 115. A motor 116 is mounted on the upper housing 11 and is coupled to one end of the cutting roller 115 so as to drive rotatably the same. The other end of the cutting roller 115 is coupled to the feed rollers 113, 114 such that the feed rollers 113, 114 rotate synchronously with the cutting roller 15.

The upper housing 11 has opposite end portions provided with a pair of upright screw sockets 111, 112. The machine 10 further includes a pair of upright threaded rods 12, 13, each of which has a lower end portion mounted rotatably on the bed 14, and an upper end portion that extends threadedly and respectively through the screw sockets 111, 112. Each of the threaded rods 12, 13 further has a bevel gear 150 mounted on the lower end portion thereof. A horizontal coupling rod 15 is mounted rotatably in the bed 14, and has opposite end portions provided with a respective bevel gear 151, 152 for meshing with the bevel gear 150 on the adjacent one of the threaded rods 12, 13. An adjusting handle 16 is mounted on the upper end portion of the threaded rod 12 so that, upon operation of the handle 16, rotation of the threaded rod 12 is transmitted to the other threaded rod 13 via the coupling rod 15. The machine 10 further includes four pillars 17 that extend upwardly from the bed 14 and slidably through corresponding bores formed in the opposite end portions of the upper housing 11. As such, the upper housing 11 can be raised or lowered relative to the bed 14 when the threaded rods 12, 13 rotate due to operation of the handle 16, thereby adjusting the height of the cutting roller 115 in accordance with the desired thickness of the finished product.

The drawbacks of the aforementioned wood planing machine are as follows:

1. When the wood planing machine 10 is in use, the upper housing 11 is constantly subjected to upward forces due to contact between the feed rollers 113, 114 and the work piece. This can lead to undesired movement of the upper housing 11 during cutting, and in uneven thickness at the front and rear parts of the work piece.

2. Rotation of the threaded rods 12, 13 when raising or lowering the upper housing 11 results in a considerable amount of noise.

SUMMARY OF THE INVENTION

Therefore, the object of the present invention is to provide a wood planing machine which generates a minimum amount of noise when an upper housing thereof is adjusted and which incorporates a locking unit for locking releasably the upper housing at a desired height with respect to a bed.

Accordingly, the wood planing machine of the present invention comprises:

a bed with opposite end portions, two pairs of spaced front and rear pillars, each of the pairs of spaced front and rear pillars extending upwardly from the bed at a respective one of the opposite end portions, and two upright threaded rods, each of which is mounted stationarily on a respective one of the opposite end portions of the bed between a respective one of the pairs of spaced front and rear pillars;

an upper housing having opposite end portions through which the front and rear pillars extend slidably, each of the opposite end portions of the upper housing having a transmission gear that is mounted rotatably thereon and that has a respective one of the threaded rods extending threadedly therethrough, the upper housing further having a horizontal coupling rod mounted rotatably thereon, the coupling rod being provided with a pair of driven members that engage the transmission gears on the upper housing such that rotation of the coupling rod results in corresponding rotation of the transmission gears and in translation of the transmission gears along the threaded rods so as to raise or lower the upper housing to a desired height relative to the bed;

a locking unit including: two pairs of first and second links, the first link in each of the pairs having an inner section and an outer section hooked on a respective one of the front pillars, the second link in each of the pairs having an inner section and an outer section hooked on a respective one of the rear pillars; and a tubular sleeve sleeved rotatably on the coupling rod and having opposite ends provided with a pair of cam units, each of the cam units engaging the inner sections of the first and second links in a corresponding one of the pairs, the tubular sleeve being rotatable to locate the cam units from a releasing position to a locking position, where the cam units pull the first and second links in each of the pairs toward each other to result in tight engagement between the first and second links and the front and rear pillars, thereby permitting locking of the upper housing at the desired height relative to the bed; and cutting and feed rollers mounted rotatably on the upper housing and rotatable about parallel horizontal axes.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
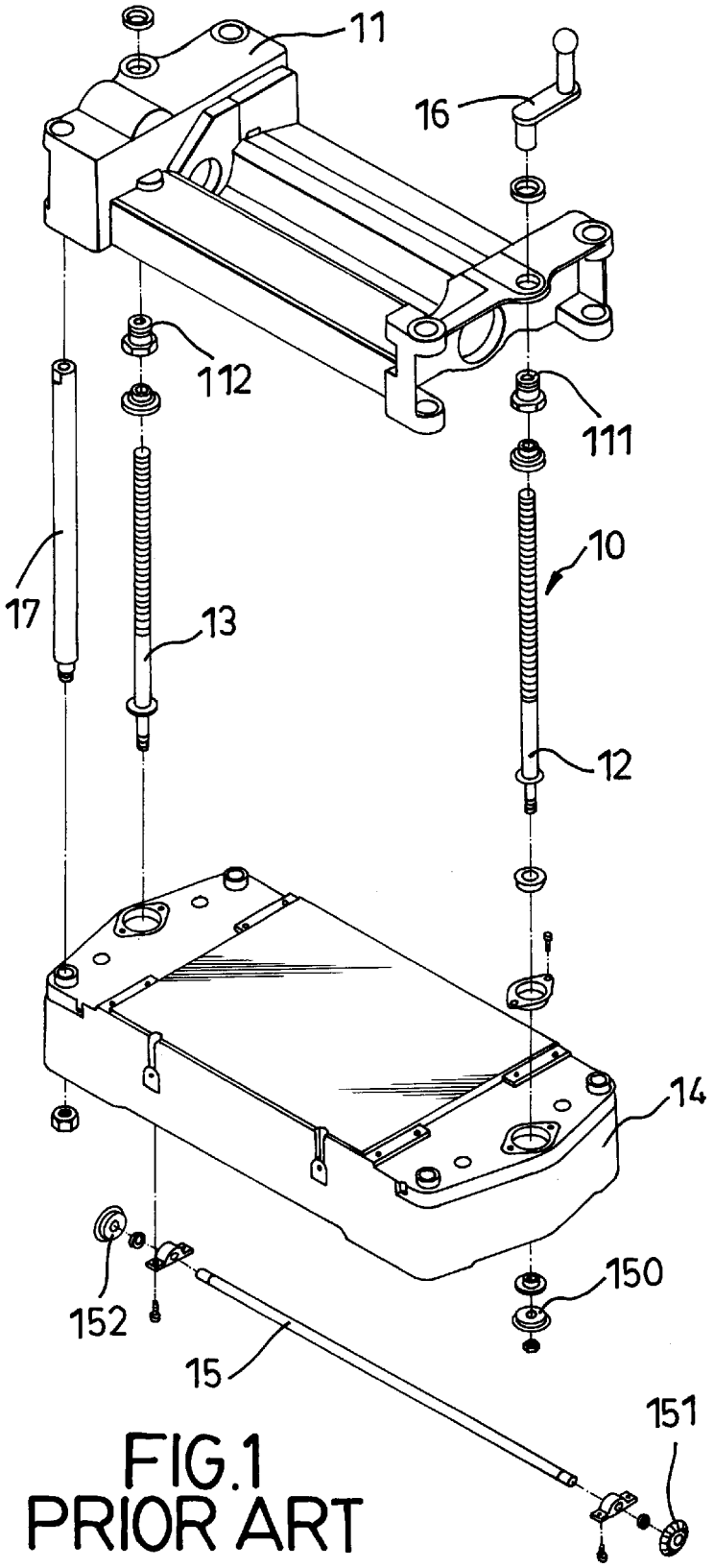
FIG.1 PRIOR ART
FIG. 1 is an exploded view of a portion of a conventional wood planing machine.
Figure 2:
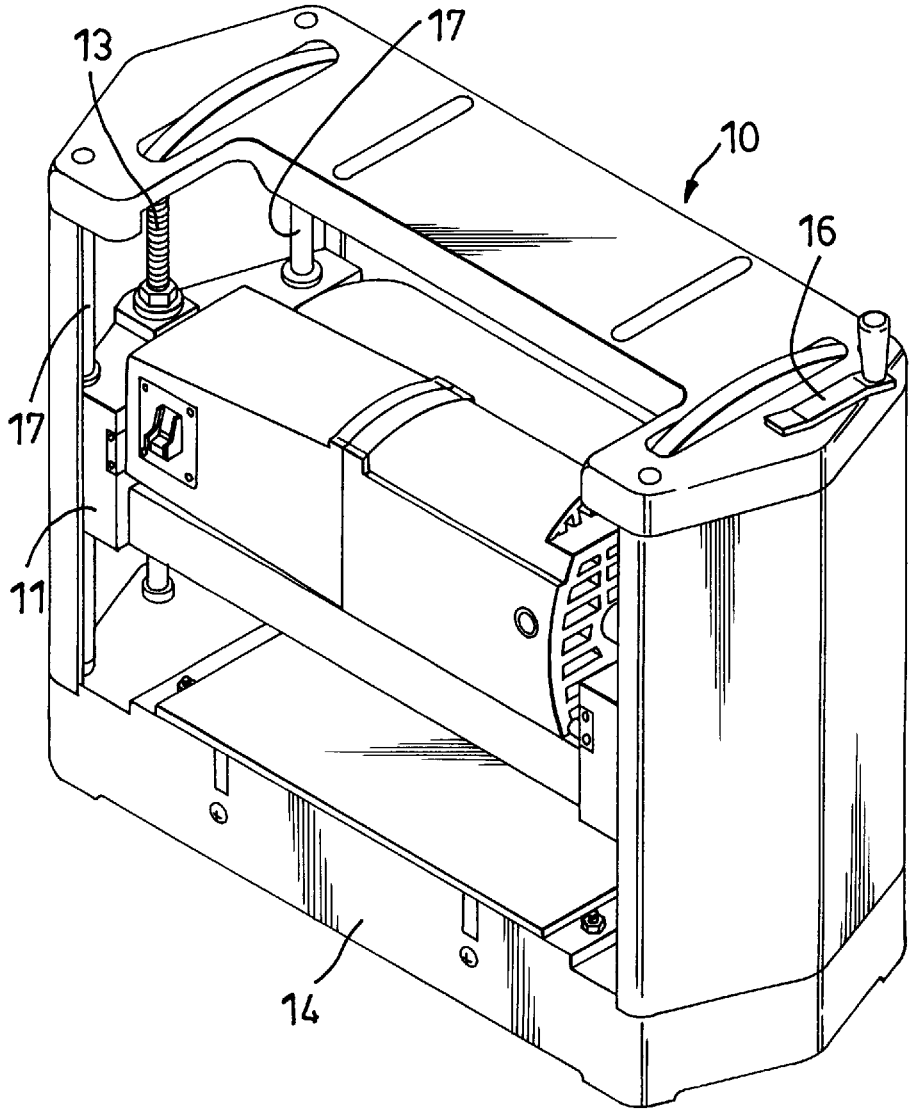
FIG.2 PRIOR ART
FIG. 2 is a perspective view of the conventional wood planing machine of FIG. 1.
Figure 3:
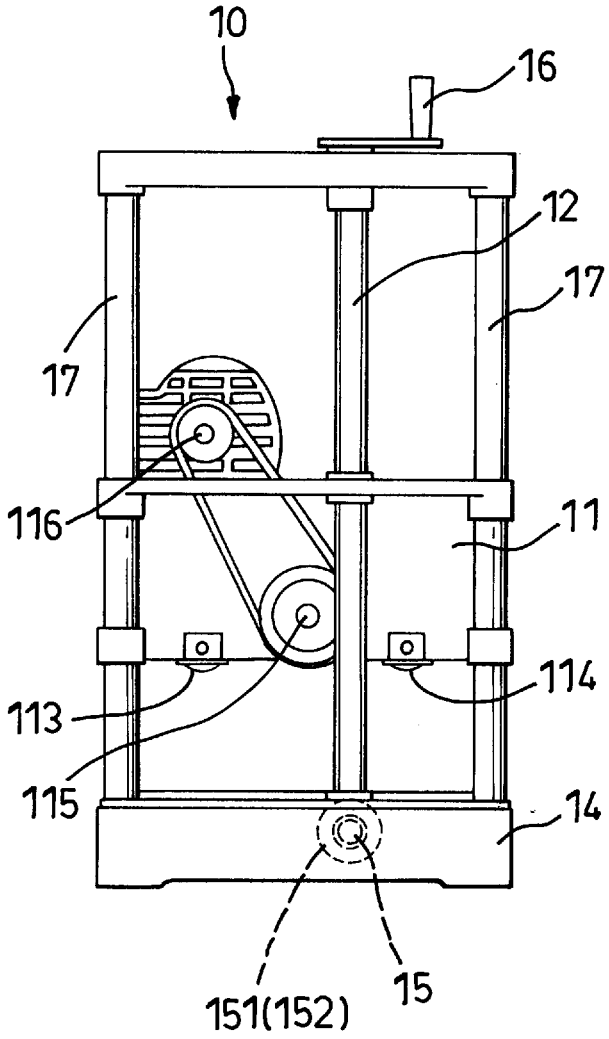
FIG.3 PRIOR ART
FIG. 3 is a schematic side view of the conventional wood planing machine of FIG. 1.
Figure 4:
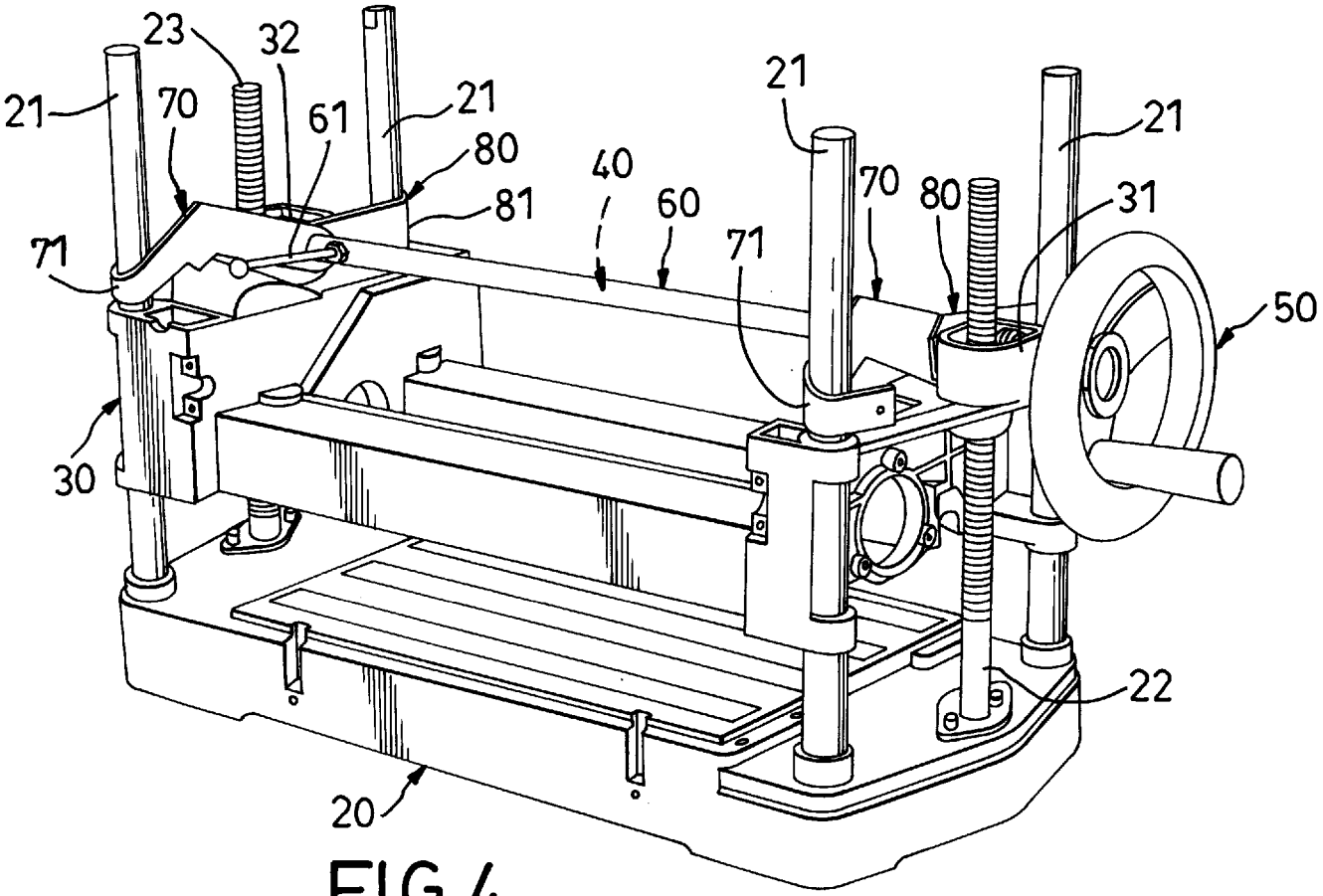
FIG. 4 is a perspective view of the preferred embodiment of a wood planing machine according to the present invention.

Referring to FIG. 4, the preferred embodiment of a wood planing machine according to the present invention is shown to comprise a bed 20 over which a wooden work piece (not shown) passes, and an upper housing 30 above the bed 20. The bed 20 has opposite end portions provided respectively with a spaced pair of upwardly extending front and rear pillars 21 that extend slidably through opposite end portions of the upper housing 30. The opposite end portions of the bed 20 are further provided with a pair of stationary threaded rods 22, 23, each of which is disposed between a corresponding pair of the front and rear pillars 21 and extends threadedly through a corresponding one of the opposite end portions of the upper housing 30.

Figure 5:
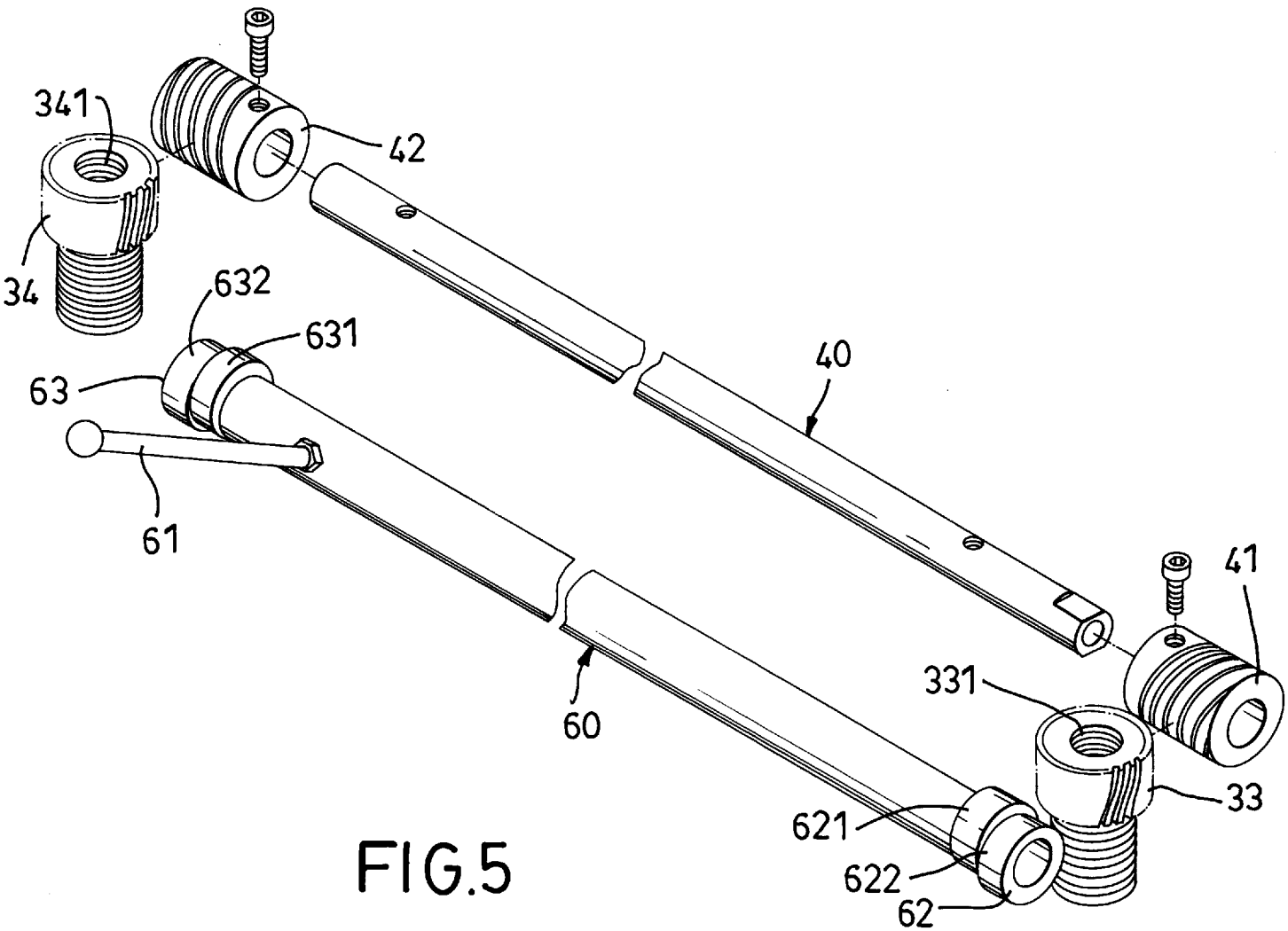
FIG. 5 is an exploded view of a portion of the preferred embodiment.
Figure 6:
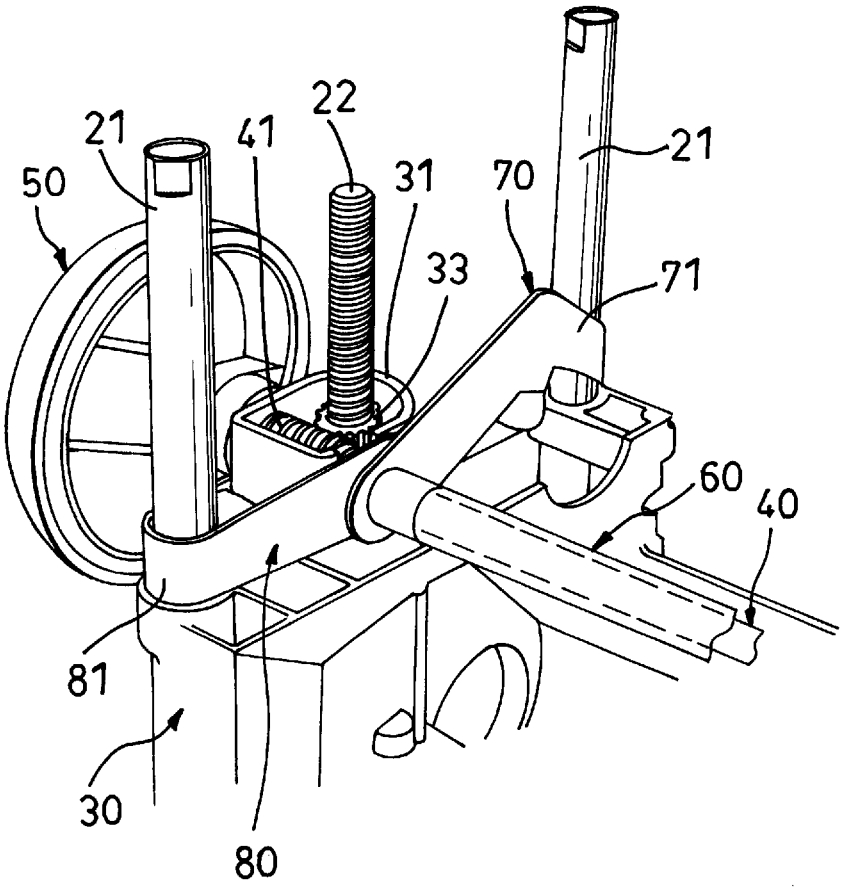
FIG. 6 is a perspective view illustrating a locking unit of the preferred embodiment.

Referring to FIGS. 4, 5 and 6, the opposite end portions of the upper housing 30 are provided with a respective seat 31, 32. Each seat 31, 32 has a transmission gear 33, 34 mounted rotatably therein. In this embodiment, the transmission gears 33, 34 are worm gears and are formed with axially extending screw holes 331, 341 that engage a respective one of the threaded rod 22, 23. A horizontal coupling rod 40 is mounted rotatably on the upper housing 30, and has opposite ends that extend rotatably into the seats 31, 32. Drive members 41, 42, such as worm shafts, are mounted securely on the opposite ends of the coupling rod 40 and mesh with the transmission gears 33, 34, respectively. An adjusting handle 50 is mounted on one of the ends of the coupling rod 40. Thus, by operating the adjusting handle 50, the coupling rod 40 rotates, thereby rotating the drive members 41, 42 therewith to result in corresponding rotation of the transmission gears 33, 34. Since the transmission gears 33, 34 are mounted rotatably to the upper housing 30 at the seats 31, 32, and since the threaded rods 22, 23 are mounted stationarily on the bed 20, rotation of the transmission gears 33, 34 will result in translation of the transmission gears 33, 34 along the threaded rods 22, 23 and in movement of the upper housing 30 with the transmission gears 33, 34 so as to raise or lower the upper housing 30 relative to the bed 20. Cutting and feed rollers (not shown) are mounted rotatably on the upper housing 30 and are rotatable about parallel horizontal axes, as is known in the art.

A tubular sleeve 60 is sleeved rotatably on the coupling rod 40. A lever 61 extends transversely from the tubular sleeve 60 adjacent to one end of the latter. Each end of the tubular sleeve 60 has a cam unit 62, 63 provided thereon. Each cam unit 62, 63 includes first and second eccentric cam members 621, 622, 631, 632 which protrude in diametrically opposite directions relative to the coupling rod 40. Each cam unit 62, 63 is associated operably with a pair of first and second links 70, 80. Each first link 70 has an inner section sleeved on the first eccentric cam member 621, 631 of the corresponding cam unit 62, 63, and a bent outer section 71 hooked on one of the front pillars 21. Each second link 80 has an inner section sleeved on the second eccentric cam member 622, 632 of the corresponding cam unit 62, 63, and a bent outer section 81 hooked on one of the rear pillars 21.

Figure 7:
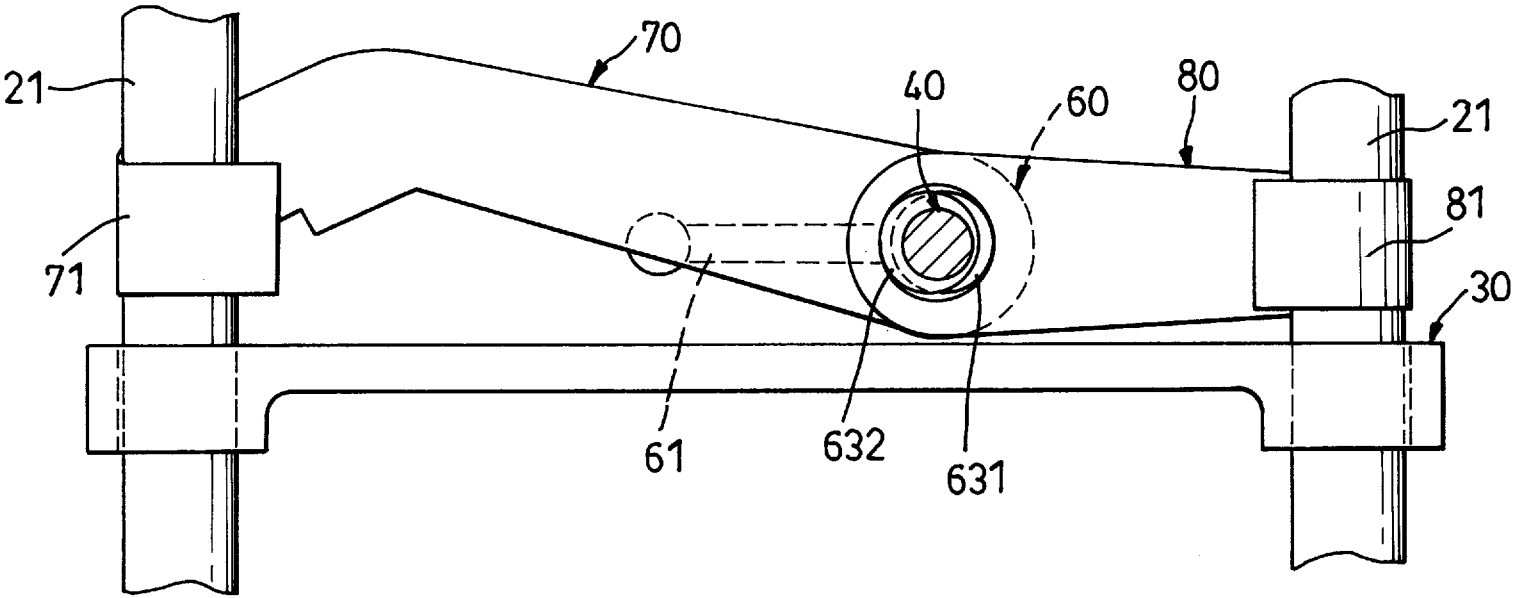
FIG. 7 is a schematic view illustrating the locking unit of the preferred embodiment in a locking position.

The tubular sleeve 60 and the two pairs of first and second links 70, 80 function as a locking unit for locking the upper housing 30 at a desired height with respect to the bed 20. Referring to FIG. 7, after adjusting the height of the upper housing 30, the lever 61 is operated in a first direction, thereby rotating the tubular sleeve 62 axially to locate the cam units 62, 63 in a locking position, where the first and second eccentric cam members 621, 622, 631, 632 protrude rearwardly and forwardly relative to the coupling rod 40. At this time, the first and second links 70, 80 are pulled toward each other to result in tight engagement with the front and rear pillars 21, thereby locking the upper housing 30 at the desired height relative to the bed 20.

Figure 8:
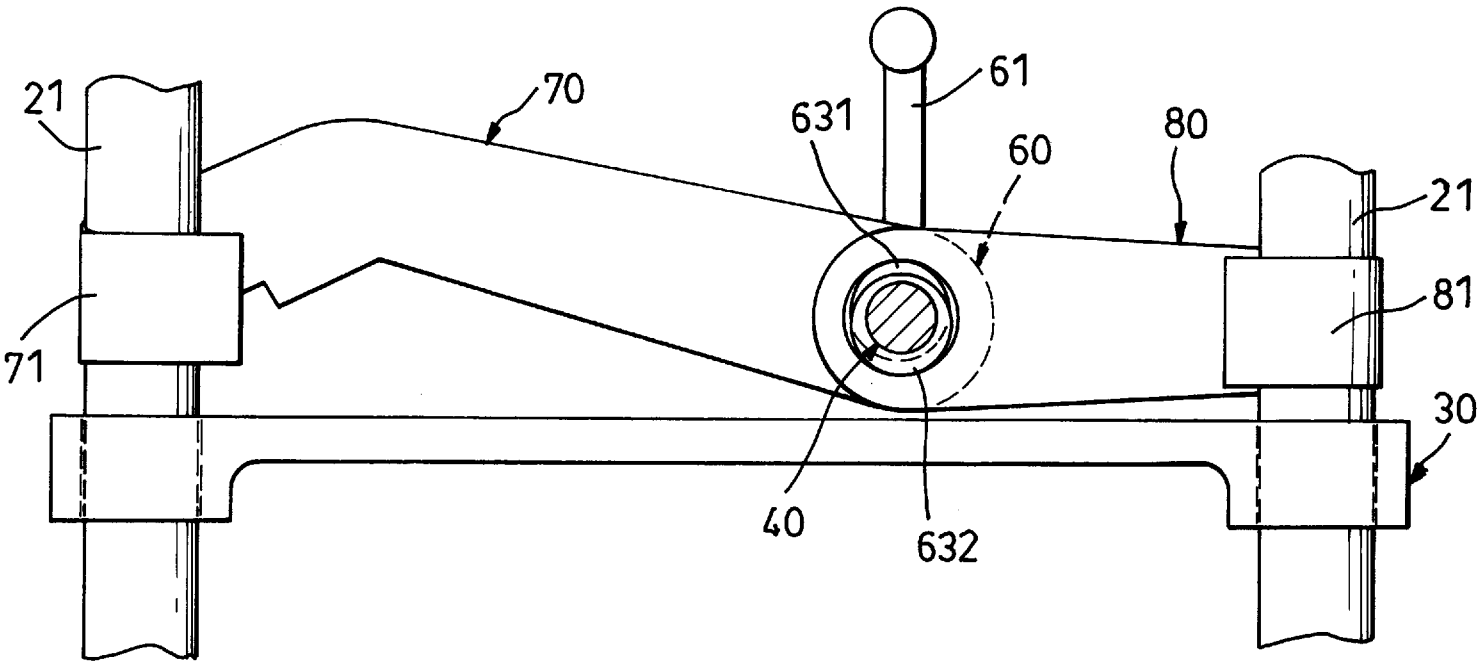
FIG. 8 is a schematic view illustrating the locking unit of the preferred embodiment in a releasing position.

Referring to FIG. 8, when it is desired to adjust the height of the upper housing 30, the lever 61 is operated in a second direction, thereby rotating the tubular sleeve 62 axially to locate the cam units 62, 63 in a releasing position, where the first and second eccentric cam members 621, 622, 631, 632 protrude upwardly and downwardly relative to the coupling rod 40. At this time, the first and second links 70, 80 cease to be pulled toward each other such that adjustment of the height of the upper housing 30 can be performed without resistance from the first and second links 70, 80.

The advantages and characterizing features of the wood planing machine of this invention are as follows:

1. Adjustment of the height of the upper housing 30 is performed via the transmission gears 33, 34 and the driven members 41, 42. Since the threaded rods 22, 23 are mounted stationarily on the bed 20, smooth movement of the upper housing 30 is ensured with a minimum amount of noise as compared to the conventional wood planing machine described beforehand.

2. The incorporation of the locking unit, which includes the tubular sleeve 60 and the two pairs of first and second links 70, 80, permits locking of the upper housing 30 at a desired height with respect to the bed 20. As such, undesired movement of the upper housing 30 can be effectively prevented during cutting to maintain an even thickness at the front and rear parts of the work piece.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A wood planing machine, comprising:

a bed with opposite end portions, two pairs of spaced front and rear pillars, each of said pairs of spaced front and rear pillars extending upwardly from said bed at a respective one of said opposite end portions, and two upright threaded rods, each of which is mounted stationarily on a respective one of said opposite end portions of said bed between a respective one of said pairs of spaced front and rear pillars;

an upper housing having opposite end portions through which said front and rear pillars extend slidably, each of said opposite end portions of said upper housing having a transmission gear that is mounted rotatably thereon and that has a respective one of said threaded rods extending threadedly therethrough, said upper housing further having a horizontal coupling rod mounted rotatably thereon, said coupling rod being provided with a pair of driven members that engage said transmission gears on said upper housing such that rotation of said coupling rod results in corresponding rotation of said transmission gears and in translation of said transmission gears along said threaded rods so as to raise or lower said upper housing to a desired height relative to said bed;

a locking unit including: two pairs of first and second links, said first link in each of said pairs having an inner section and an outer section hooked on a respective one of said front pillars, said second link in each of said pairs having an inner section and an outer section hooked on a respective one of said rear pillars; and a tubular sleeve sleeved rotatably on said coupling rod and having opposite ends provided with a pair of cam units, each of said cam units engaging said inner sections of said first and second links in a corresponding one of said pairs, said tubular sleeve being rotatable to locate said cam units from a releasing position to a locking position, where said cam units pull said first and second links in each of said pairs toward each other to result in tight engagement between said first and second links and said front and rear pillars, thereby permitting locking of said upper housing at the desired height relative to said bed; and cutting and feed rollers mounted rotatably on said upper housing and rotatable about parallel horizontal axes.

2. The wood planing machine as claimed in claim 1, wherein each of said cam units includes first and second eccentric cam members which protrude in diametrically opposite directions relative to said coupling rod, said first eccentric cam member having said inner section of a corresponding one of said first links sleeved thereon, said second eccentric cam member having said inner section of a corresponding one of said second links sleeved thereon.

3. The wood planing machine as claimed in claim 2, wherein said first and second eccentric cam members protrude rearwardly and forwardly relative to said coupling rod in the locking position, and upwardly and downwardly relative to said coupling rod in the releasing position.

4. The wood planing machine as claimed in claim 1, wherein said outer section of each of said first and second links is bent for hooking on the respective one of said front and rear pillars.

5. The wood planing machine as claimed in claim 1, wherein said coupling rod is further provided with an adjusting handle.

6. The wood planing machine as claimed in claim 1, wherein said tubular sleeve is provided with a lever that extends transversely therefrom.

7. The wood planing machine as claimed in claim 1, wherein each of said transmission gears is a worm gear, and each of said driven members is a worm shaft.

* * * * *